US010588482B2

(12) United States Patent
Kim et al.

(10) Patent No.: US 10,588,482 B2
(45) Date of Patent: Mar. 17, 2020

(54) DISHWASHER

(71) Applicant: LG Electronics Inc., Seoul (KR)

(72) Inventors: Pilsu Kim, Seoul (KR); Gyuhan Hwang, Seoul (KR)

(73) Assignee: LG Electronics Inc., Seoul (KR)

( * ) Notice: Subject to any disclaimer, the term of this patent is extended or adjusted under 35 U.S.C. 154(b) by 98 days.

(21) Appl. No.: 15/743,824

(22) PCT Filed: Jul. 13, 2016

(86) PCT No.: PCT/KR2016/007590
§ 371 (c)(1),
(2) Date: Jan. 11, 2018

(87) PCT Pub. No.: WO2017/018696
PCT Pub. Date: Feb. 2, 2017

(65) Prior Publication Data

US 2018/0192850 A1 Jul. 12, 2018

(30) Foreign Application Priority Data

Jul. 24, 2015 (KR) ..... 10-2015-0104810

(51) Int. Cl.
*A47L 15/48* (2006.01)
*A47L 15/42* (2006.01)

(52) U.S. Cl.
CPC ..... *A47L 15/488* (2013.01); *A47L 15/4257* (2013.01)

(58) Field of Classification Search
CPC ..... A47L 15/488
See application file for complete search history.

(56) References Cited

U.S. PATENT DOCUMENTS 3,680,940 A 8/1972 Johansson et al.
3,876,469 A 4/1975 Schimke
(Continued)

FOREIGN PATENT DOCUMENTS

DE 2937589 4/1981
KR 1996003679 7/1996
(Continued)

OTHER PUBLICATIONS

International Search Report and Written Opinion in International Application No. PCT/KR2016/007590, dated Nov. 3, 2016, 13 pages.
(Continued)

*Primary Examiner* — Jason Y Ko
(74) *Attorney, Agent, or Firm* — Fish & Richardson P.C.

(57) ABSTRACT

Disclosed is a dishwasher comprising a cabinet, a tub defining a washing space, a door rotatably coupled to a front portion of the tub, an outlet duct provided in the door and exhausting internal air of the tub outside, an inlet duct connected to the outlet duct and sucking and blowing the internal air of the tub toward the outlet duct, a hole cover selectively opening and closing an air inlet hole provided in an entrance of the inlet duct, and a foreign substance intake preventing chamber provided under the air inlet hole and inclined downwards toward a rear surface of the door, the foreign substance intake preventing chamber preventing foreign substances from becoming drawn into the air inlet hole.

18 Claims, 6 Drawing Sheets

(56) References Cited

U.S. PATENT DOCUMENTS

| | | | | |
|---|---|---|---|---|
| 4,184,500 | A | 1/1980 | Herbst | |
| 5,836,324 | A | 11/1998 | Johnson et al. | |
| 2007/0171609 | A1* | 7/2007 | Kehl | H05K 7/20181 361/690 |
| 2010/0192977 | A1 | 8/2010 | Jadhav et al. | |
| 2014/0150286 | A1* | 6/2014 | Jadhav | A47L 15/0034 34/443 |
| 2014/0223761 | A1* | 8/2014 | Lee | A47L 19/00 34/218 |
| 2015/0196188 | A1 | 7/2015 | Li et al. | |

FOREIGN PATENT DOCUMENTS

| | | | |
|---|---|---|---|
| KR | 352289 | B | 9/2002 |
| KR | 2007074273 | B | 7/2007 |
| KR | 2007105056 | B | 10/2007 |
| KR | 1130401 | B | 3/2012 |

OTHER PUBLICATIONS

Extended European Search Report in European Application No. 16830729.6, dated Apr. 4, 2019, 10 pages.

* cited by examiner

[Fig. 1]
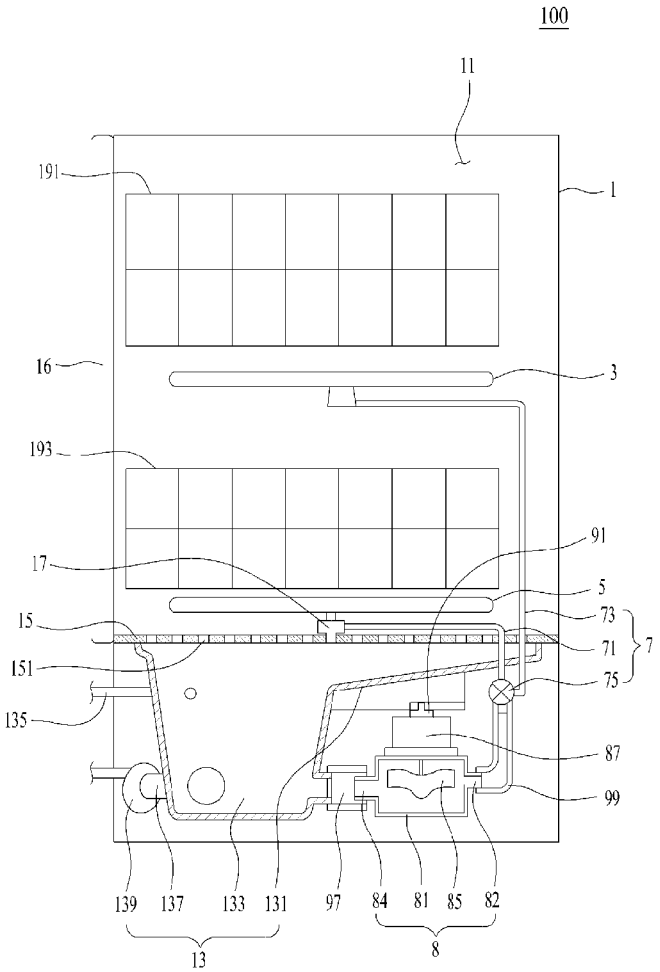

[Fig. 2]
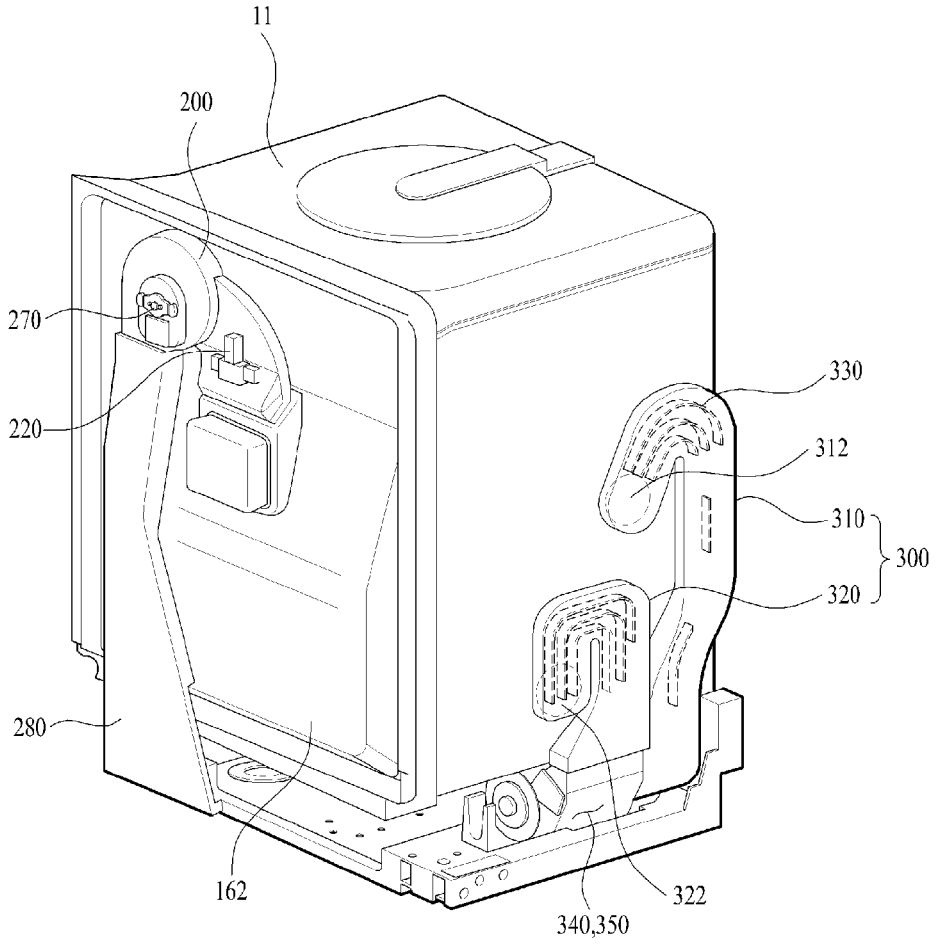

[Fig. 3]
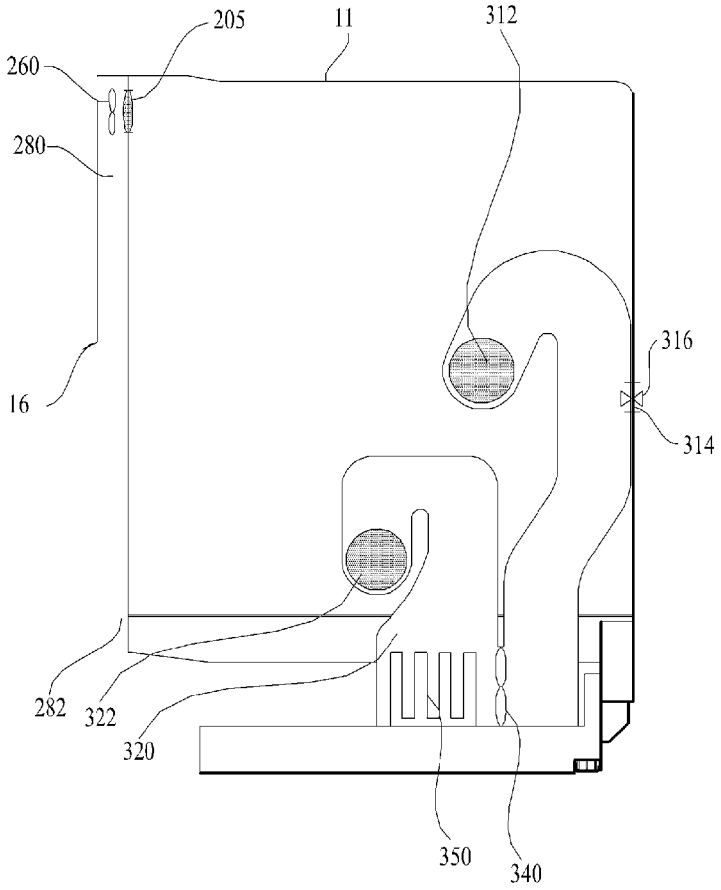

[Fig. 4]
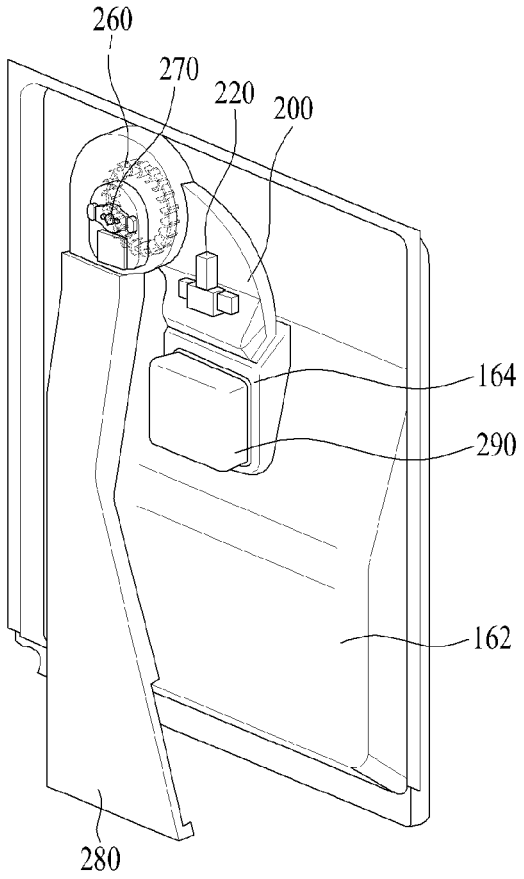

[Fig. 5]
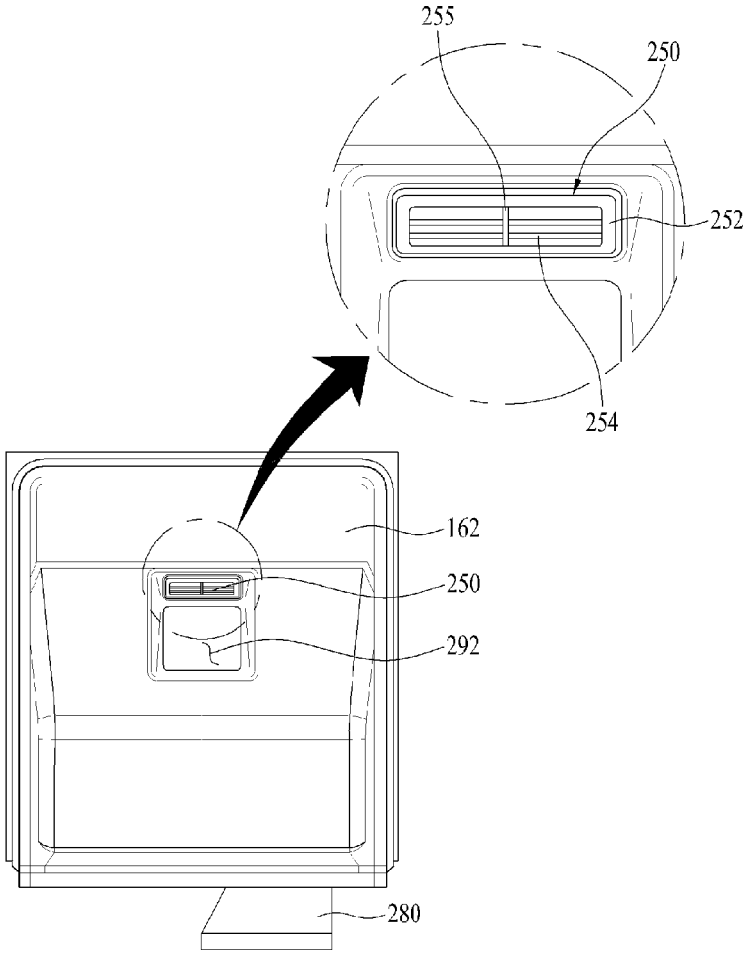

[Fig. 6]
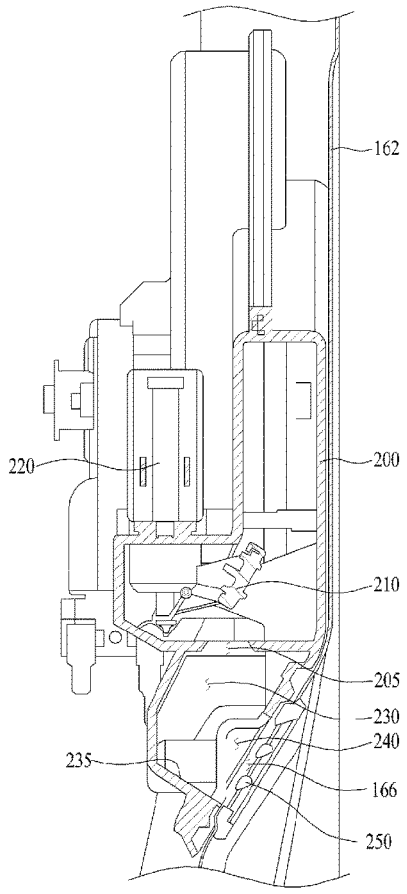
[Fig. 7]
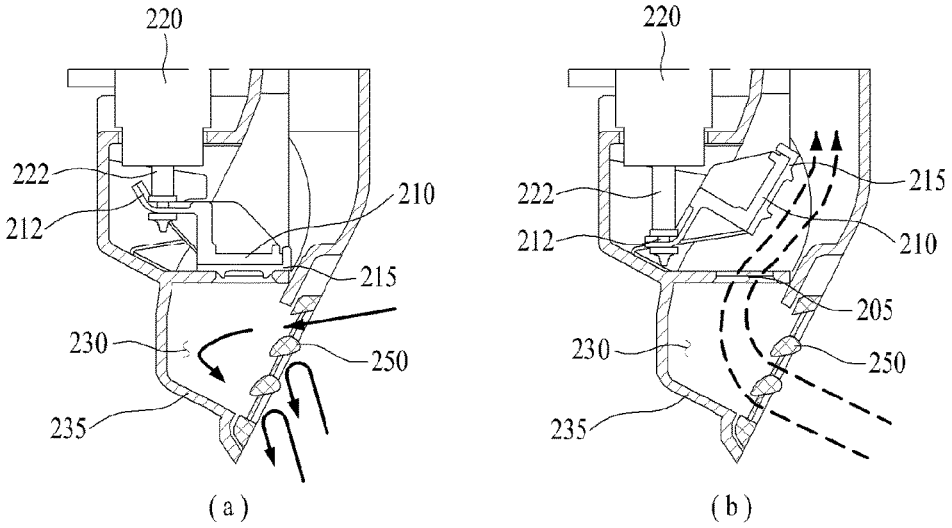

DISHWASHER

CROSS-REFERENCE TO RELATED APPLICATIONS

This application is a National Stage application under 35 U.S.C. § 371 of International Application No. PCT/KR2016/007590, filed Jul. 13, 2016, which claims the benefit of Korean Application No. 10-2015-0104810, filed on Jul. 24, 2015. The disclosures of the prior applications are incorporated by reference in their entirety.

TECHNICAL FIELD

Embodiments of the present disclosure relate to a dishwasher, more particularly, to a dishwasher having the structure configured to prevent moisture or foreign substances from getting into an inlet duct for exhausting air.

BACKGROUND ART

Dishwashers are the apparatuses configured to remove food scraps which remains on dishes or cooking tools (hereinafter, washing objects) using wash water.

A conventional dishwasher includes a tub defining a washing space, a rack provided in the tub and accommodating washing objects, an injection arm injecting washing water to the rack, a sump in which the washing water is stored, and a pump supplying the wash water stored in the sump to the injection arm.

Such a dishwasher may be configured to perform a washing course for washing off the food scraps which contains on washing objects; a rinsing course for rinsing the washing objects having been in the washing course; and a drying course for drying the moisture which contains on the washing objects having been in the rinsing course.

As one of such a dishwasher, Korean Patent No. 10-2011-004578 (hereinafter, the conventional dishwasher) discloses a dishwasher according to prior art to which the present disclosure pertains.

In the disclosed dishwasher, a circulation duct in communication with an internal washing space of a tub is provided outside the tub and a condensation partition wall is provided in the circulation and condensing the circulating humid air to perform a drying course.

After such a drying course, an outlet duct provided in a door may exhaust air outside.

As another example, the humid air may be directly exhausted through the outlet duct, without condensing the humid air through the circulation duct.

An air inlet hole for sucking air into the outlet duct is provided in a rear surface of the door and a hole cover is provided in the air inlet hole to selectively open and close the air inlet hole.

The hole cover is able to be horizontally moved by an actuator coupled to an inner surface of the door.

An inlet duct configured as a case type having the actuator and the hole cover is mounted between the air inlet hole and the outlet duct.

A fan is mounted in the inlet duct to blow air to the outlet duct.

The actuator moving the hole cover is horizontally mounted to the inlet duct.

However, the hole cover is open in the drying course and the vapor and air inside the tub is exhausted through the outlet duct in the conventional dishwasher. The conventional dishwasher has the disadvantage that water is collected right in the inlet hole of the inlet duct.

That is because water leaks into the gap between the inlet hole and the hole cover even when the hole cover closes the inlet during the hot vapor condensation or washing process.

Accordingly, the user has to connect a hose to the inlet duct and remove the water collected in the inlet duct.

Some food traps would be contained in the collected water and such the food traps contained in the collected water is likely not to be removed together with water but to remain in the inlet duct. Such the food traps and water might cause errors in the internal components of the inlet duct such as the actuator.

DISCLOSURE OF INVENTION

Technical Problem

To overcome the disadvantages, an object of the present disclosure is to provide a dishwasher which allows not water but only air to flow into the inlet duct and which includes a foreign substance intake provided under an air inlet hole of the inlet duct and allowing some of the injected water to flow therein, with an inclined bottom surface to wash off the foreign substances drawn into the chamber by using the water, so that the foreign substances and water may be prevented from being collected.

Solution to Problem

To achieve these objects and other advantages and in accordance with the purpose of the embodiments, as embodied and broadly described herein, a dishwasher comprises a cabinet; a tub defining a washing space; a door rotatably coupled to a front portion of the tub; an outlet duct provided in the door and exhausting internal air of the tub outside; an inlet duct connected to the outlet duct and sucking and blowing the internal air of the tub toward the outlet duct; a hole cover selectively opening and closing an air inlet hole provided in an entrance of the inlet duct; and a foreign substance intake preventing chamber provided under the air inlet hole and inclined downwards toward a rear surface of the door, the foreign substance intake preventing chamber preventing foreign substances from becoming drawn into the air inlet hole.

The air inlet hole may be formed in a bottom surface of the inlet duct.

The dishwasher may further include a grill cover coupled to a penetrating hole formed in a rear surface of the door, in communication with the foreign substance intake preventing chamber, and guiding only the water injected inclinedly downwards from a top portion of the door.

An inlet hole of the foreign substance intake preventing chamber may formed inclinedly downwards toward a front of the door.

The grill cover may comprise a plurality of blind ribs inclinedly formed in the reverse direction of a bottom surface of the foreign substance intake preventing chamber; and a rim integrally formed with the plurality of the blind ribs and having a bottom surface being flush with a bottom surface of the foreign substance intake preventing chamber.

The hole cover may be closed while a washing course is performed, and the hole cove may be open while a rinsing course and a drying course are performed or in a standby state.

The hole cover may be rotatably coupled to the air inlet hole and the hole cover is configured to open and close the air inlet hole by an actuator having a rod vertically movable.

The actuator may be a thermal actuator configured to move the rod by using the working fluid expanded when heated.

The thermal actuator may be mounted over the air inlet hole of the inlet duct and may be mounted on an outside of the inlet duct, and the rod may be projected into the internal space of the inlet duct.

The inlet duct may further comprise a blower fan blowing the air sucked through the air inlet hole toward the outlet duct.

The blower fan may be a centrifugal fan configured to be rotated by a motor coupled to a front surface of the inlet duct.

The outlet duct may be connected to an end of the inlet duct downwardly to exhaust the air blown by the blower fan to a lower portion of the door.

Further scope of applicability of the present invention will become apparent from the detailed description given hereinafter. However, it should be understood that the detailed description and specific examples, while indicating preferred embodiments of the invention, are given by illustration only, since various changes and modifications within the spirit and scope of the invention will become apparent to those skilled in the art from this detailed description.

Advantageous Effects of Invention

The embodiments have following advantageous effects. According to the dishwasher in accordance with the present disclosure, only air is sucked into the inlet duct and no water is sucked, so that water and foreign substances may not be collected in the bottom of the inlet duct.

Furthermore, water is prevented from flowing to the air inlet hole even if there is a gap between the air inlet hole and the hole cover closing the air inlet hole airtight. Accordingly, water may be prevented from flowing into the inlet duct through the gap.

Still further, the foreign substance intake preventing chamber is provided under the inlet duct and the flowing of the washing water into the air inlet hole is controlled along the inlet direction of the washing water. Accordingly, the foreign substances drawn into the chamber may be washed off.

Still further, the bottom surface of the foreign substance intake preventing chamber is inclined downwards toward the rear surface of the door and the water flowing into the chamber may re-flow together with the foreign substances, to re-flow into the tub.

BRIEF DESCRIPTION OF DRAWINGS

The present invention will become more fully understood from the detailed description given herein below and the accompanying drawings, which are given by illustration only, and thus are not limitative of the present invention, and wherein:

FIG. 1 is a diagram schematically illustrating a structure of a dishwasher in accordance with the present disclosure;

FIG. 2 is a perspective diagram illustrating one example of the dishwasher in accordance with the present disclosure;

FIG. 3 is a lateral view schematically illustrating one example of the dishwasher;

FIG. 4 is a perspective diagram illustrating a door shown in FIG. 2;

FIG. 5 is a perspective diagram of the door shown in FIG. 4, viewed from a back side;

FIG. 6 is a longitudinal sectional diagram of an inlet duct mounted to a door, cut away along a plane passing the inlet duct; and FIG. 7 is a sectional diagram illustrating the operation of the inlet duct shown in FIG. 6.

BEST MODE FOR CARRYING OUT THE INVENTION

Referring to the accompanying drawings, preferred examples of the present disclosure will described.

As shown in FIG. 1, one example of the dishwasher 100 includes a cabinet 1 defining an exterior appearance; a tub 11 provided in the cabinet and providing a washing space; one or more racks 191 and 193 provided in the tub and providing some space in which washing objects are accommodated, one or more injection arm 3 and 5 injecting washing water to the racks, a sump 13 collecting the washing water injected into the tub therein; and a supply pump 8 supplying the washing water stored in the sump 13 to the one or more injection arms 3 and 5.

A base support 200 may be provided in a lower portion of the cabinet 1 and the base support 200 may define a lower profile of the cabinet 1.

The one or more racks may include a first rack 191 (or an upper rack) and a second rack 193 (or a lower rack) arranged under the first rack.

A door 16 is coupled to the cabinet 1 to open and close the tub 11. When the door is open 16, the upper rack 191 and the lower rack 193 are configured to slidingly move out from the tub 11.

In other word, rails (not shown) are provided in an inner surface of the tub to guide the sliding movement of the racks 191 and 193 toward the door 16. Rollers (not shown) supported by the rails may be further provided in the racks.

The sump 13 may include a storage 133 for storing the washing water, a cover 15 located in a top of the storage 133 to partition off the storage 133 from the tub 11 and a connecting portion 131 connecting the storage 133 to the cover 15.

In this instance, a collecting hole 151 may be further provided in the cover 15 to supply washing water to the storage 133. The collecting hole 151 penetrates the sump cover 15.

The collecting hole 151 may be provided only in the region of the cover 15 over the storage 133 or collecting holes 151 may be provide in the overall region of the cover 15, to supply the washing water inside the tub 11 to the connecting portion 131.

The connecting portion 131 may be inclined toward the storage 133 at a preset angle so as to guide the washing water drawn through the collecting hole 151.

It is preferred that the tub 11 is arranged over the cover 15 so that the washing water injected into the tub by the injection arms 3 and 5 can be collected in the storage 133 by the collecting hole 151 and the connecting portion 131, even without any auxiliary mechanisms.

The cover 15 may be provided as any types only when capable of partitioning off the internal space of the cabinet into the spaces. The connecting portion 131 may be fixed to a bottom of the cover 15.

The connecting portion 131 may be provided to surround the lower space of the cover 15 (in other words, the flat area of the cover is equal to that of the body) or to surround only the space where the collecting hole 151 is formed.

Meanwhile, the storage 133 may be formed by concavely recessing the cover 15 toward the bottom surface of the cover 15. The cross sectional area of the storage 133 may be smaller than the area of the connecting portion 131 and preferably, the connecting portion 131 is inclined toward the storage 133 downwards.

When the cross sectional area of the storage 133 is smaller than the area of the connecting portion 131, the pump 8 may be located in a lower region with respect to the connecting portion 131. Accordingly, the overall volume of the dishwasher 100 may be minimized.

The storage 133 is supplied the washing water through a water supply path 135 connected to a water supply source (not shown) and the washing water stored in the storage 133 is exhausted outside the cabinet 1 through a drainage path 137 by a drainage pump 139.

The injection arm provided in the dishwasher in accordance with the present disclosure may include a lower arm 5 provided in the tub 11 and washing the washing objects held in the lower rack 193; and an upper arm 3 washing the washing objects held in the upper rack 191.

The lower arm 5 and the upper arm 3 are supplied washing water through a water supply path 7 by the pump 8. The water supply path 7 may include a first water supply path 71 connected to the lower arm 5, a second water supply path 73 connected to the upper arm 3 and a transfer valve 75 selectively opening the water supply paths 71 and 73.

In case the lower arm 5 is rotatably provided in the tub 11, the lower arm 5 is rotatably coupled to a holder 17 provided in the cover 15 and the first water supply path 71 is configured to supply washing water to the holder 17.

Meanwhile, in case the upper arm 3 is rotatably provided in the tub 11, the upper arm 3 is rotatably coupled to the second water supply path 73.

The pump 8 may include a housing 81 having an impeller 85; a water inlet hole 84 for supplying washing water to the housing 81; a water outlet hole 82 for exhausting the washing water inside the housing 181; and a motor 87 provided outside the housing 181 and rotating the impeller 186.

The water inlet hole 84 is connected to the storage 133 via an inlet hole connection pipe 97 and the water outlet hole 82 is connected to the transfer valve 75 via an outlet hole connection pipe 99.

Accordingly, once the motor 87 provided with the electric power is put into operation to rotate the impeller 85, the water supplied to the housing 81 from the sump 13 flows to the transfer valve 75 through the outlet hole 83 and the water supplied to the transfer valve 75 flow to the upper arm 3 or the lower arm 5 along the water supply path 71 or 73 open by the transfer valve 75.

The pump 8 is fixed in the cabinet 1 through an insulation unit 91. The insulation unit 91 dampers the vibration generated in the pump 8 and prevents the vibration from getting delivered to the sump 13 and the cabinet 1.

Two or more insulation units provided in the dishwasher in accordance with the present disclosure may be provided as means for allowing the bottom surface of the cabinet 1 and also the sump 13 spaced a preset distance apart from an outer circumferential surface of the pump 8.

FIG. 2 illustrates one example of the dishwasher. FIG. 2 shows a door liner 162 defining a rear surface of the door and the internal components of the door 16, with no front panel provided in the door 16 and no cabinet.

FIG. 3 is a lateral view schematically illustrating one example of the dishwasher.

Referring to FIGS. 2 and 3, the air circulation and exhaustion structure performed in the illustrated example of the dishwasher will be described.

A circulation duct 300 is provided in one lateral wall of the tub 11. The circulation duct 300 is in communication with the inner space of the tub 11 so as to suck the internal air of the tub 11 and exhaust the sucked air into the tub 11 again.

The circulation duct 300 may include a circulation air inlet duct 310 sucking the internal air of the tub 11 and a circulation air outlet duct 320 re-exhausting (or resupplying) the sucked air to the tub 11.

A circulation fan 340 is provided in the circulation duct 300 and circulates the air between the inner space of the tub 11 and the circulation duct 300. The circulation fan 340 may be arranged between the circulation air inlet duct 310 and the circulation air outlet duct 320.

In other word, the circulation air inlet duct 310 and the circulation air outlet duct 320 are in communication with each other and the circulation fan 340 is mounted in the communication region to rotate for air circulation.

A circulation air inlet hole 312 in communication with the circulation air inlet duct 310 and a circulation air outlet hole 322 in communication with the circulation air outlet duct 320 may penetrate one lateral wall of the tub 11.

The circulation outlet hole 322 is arranged lower than the circulation inlet hole 312, so that the air exhausted into the tub 11 via the circulation air outlet hole 322 can rise into the circulation air inlet hole 312.

The circulation air inlet hole 312 may be arranged farther back than the circulation air outlet 322.

The circulation air inlet duct 310 may be extended upwards from the circulation air outlet hole 322 and then downwards.

The circulation air outlet duct 320 may be extended upwards from the circulation air outlet hole 322 and then downwards.

Also, the circulation duct 300 may further include a condensation partition wall 330 longitudinally formed along a direction of air flux so as to condense the moisture contained in the air. A plurality of condensation partition walls 330 may be formed or one condensation partition wall 330 may be provided in each of the circulation air inlet duct 310 and the circulation air outlet duct 320.

The water condensed in the condensation partition wall 330 flows down to be exhausted outside via the drainage path (137, see FIG. 1).

Meanwhile, an external air inlet hole 314 may be provided in the circulation air inlet duct 310 to suck external air therein. The external air inlet hole 314 may be provided in a rear surface of the circulation air inlet duct 310 to communicate with the rear surface of the cabinet 1.

An external air adjusting unit 316 may be provided to adjust the opening and closing of the external air inlet hole 214. The external air adjusting unit 316 may be a valve for adjusting the intake of external air. When the external air adjusting unit 316 opens the external air inlet hole 314, external air may be sucked into the circulation air inlet duct 310 by the circulation fan 340.

The circulation duct 300 may further include a heating unit 350 heating the air sucked into the circulation duct 300.

The heating unit 350 may be realized as the electric heater provided in the circulation air outlet duct 320 and able to promote the drying by raising the temperature of air and increasing the amount of saturated water vapor.

According to the illustrated embodiment of the present disclosure, the circulation duct 300 may operate the circulation fan 340 and the heating unit 350 and condense the air so as to promote the drying process.

The internal air of the tub 11 dried by the circulation duct 300 may be exhausted via an outlet duct 280 provided in the door 16.

The outlet duct 280 may be provided in the door 16 and an air outlet hole 282 may be provided under the door 16, so that the air may be exhausted outside via the air outlet hole 282.

An air inlet hole 205 in communication with the outlet duct 280 is provided in the rear surface of the door 16 and the air inlet hole 205 is open and closed by a hole cover (210, see FIG. 6) which will be described later.

The hole cover 210 shown in FIG. 2 may be put into operation to open and close the air inlet hole 205 by the actuator 220 mounted in the door 15.

As shown in FIG. 3, a blower fan 260 is mounted in the door 16 to exhaust the air sucked via the air inlet hole 205 outside via the outlet duct 280.

The actuator 220 and the blower fan 260 may be directly mounted to the outlet duct 280. In this instance, the mounting structure is likely to become complex and not to facilitate the air flux.

Accordingly, it is preferred that an inlet duct 200 guiding the air sucked via the air inlet hole 205 toward the outlet duct 280 is provided between the air inlet hole 205 and the outlet duct 280. The actuator 220 and the blower fan 260 are mounted to the inlet duct 200.

Meanwhile, the present disclosure may be applicable to a dishwasher having no circulation duct 300. In other words, after a washing course is performed in the dishwasher, a drying course opens the air inlet hole 205 and operates the blower fan 260 to ventilate the air sucked into the inlet duct 200 toward the outlet duct 280 and to exhaust the air outside, without the drying facilitation process performed by the circulation duct.

In this instance, more humid air is likely to get sucked into the inlet duct 200 than the humid air having been in the drying facilitation process performed by the circulation duct.

Referring to FIGS. 4 through 6, the internal structure of the door provided in one example of the dishwasher will be described in detail.

As shown in FIG. 4, the door liner 162 is formed in a rectangular plate shape. An inner rim portion is projected backwards and a front portion is recessed. A lower portion of the door liner 162 is projected forwards again and a middle portion between the upper recessed portion and the lower convex portion is inclined.

A central upper region of the inclined middle portion is more projected enough to form a projection 164. A top of the projection 164 is projected at a larger angle with respect to a vertical plane of the door liner 162 than the middle portion. A bottom of the projection 164 may substantially form a perpendicular plane.

As shown in FIG. 5, a loading hole 292 is penetrated in a lower surface of the projection and a detergent dispenser 290 shown in FIG. 4 may be loaded in the loading hole 292.

The detergent dispenser 290 may be substantially rectangular-shaped.

The user opens the door 16 and then the cover provided in an upper surface of the door liner 162. After that, the user put detergent in the door dispenser and closes the door 16. The cover is controlled to open so that the detergent can be introduced into the tub 11.

A penetrating hole (166, see FIG. 6) is formed in a top of the projection 164 and the inlet duct 200 is mounted in communication with the penetrating hole 166.

The air inlet hole 205 provided in an entrance of the inlet duct 200 to suck air may be selectively open and closed by the hole cover 210 shown in FIG. 6.

The air inlet hole 205 is in communication with the penetrating hole 166 of the door liner 162 not directly but through a foreign substance intake preventing chamber 230 provided between the air inlet hole 205 and the penetrating hole 166.

In other words, the air inlet hole 205 of the inlet duct 200 is not in contact with the penetrating hole 166 of the door liner 162 and the foreign substance intake preventing chamber 230 is provided between the air inlet hole 205 and the penetrating hole 166.

The foreign substance intake preventing chamber 230 may be integrally formed with the inlet duct 200. The air inlet hole 205 may form the bottom of the inlet duct 200 and be provided in the partition wall forming the ceiling of the foreign substance intake preventing chamber 230.

The foreign substance intake preventing chamber 230 is inclined downwards for the bottom to become toward the rear surface of the door 16.

A rear wall of the foreign substance intake preventing chamber 230 is almost perpendicularly inclined with respect to the bottom 235 and an inlet hole 240 sucking air and water is formed in a lower portion of the rear wall.

In other words, the inlet hole 240 is inclined downwards to the front of the door 16.

The foreign substance intake preventing chamber 230 is arranged for the inlet 240 to become corresponding to the penetrating hole 166 of the door liner 162.

Accordingly, the water injected into the tub 11 in the washing course and the foreign substances contained in the water are drawn into the foreign substance intake preventing chamber 230. As the air inlet 205 is closed by the hole cover 210, the water and foreign substances will not come into the inlet duct 200.

Moreover, when the door 16 is closed to become arranged vertically, the air inlet hole 205 is formed horizontal with respect to the bottom of the inlet duct 200. Accordingly, even if a gap is formed between the air inlet hole 205 and the hole cover 210, water cannot get sucked into the inlet duct 200.

When humid air is sucked into the inlet duct 200, with the open door 16, even vapor is condensed from the humid air getting into the inlet duct 200 and the condensed water may flow down into the foreign substance intake preventing chamber 230 via the air inlet hole 205.

In the conventional dishwasher, the cover is normally closed and open only in the drying course. However, in the example of the dishwasher, the hole cover 210 is normally open and only closed in the washing course by the controlling the actuator 250.

That is possible because the location of the air inlet hole 205 provided in the inlet duct 200, the arrangement location and structure of the foreign substance intake preventing chamber are uniquely different from the corresponding structural characteristics of the components provided in the conventional dishwasher. Accordingly, the hole cover 210 is open not only in the drying and washing courses but also in the normal state and the moisture inside the tub 11 may be exhausted consistently.

A grill cover 250 is coupled to the penetrating hole 166 of the door liner 162 and guides only the water injected downwards from the upper portion of the tub 11 to flow into the penetrating hole 166.

The upper arm 3 of the injections arms 3 and 5 may be arranged over the penetrating hole 166 and the lower arm 5 may be arranged below the penetrating hole 166.

The grill cover 250 allows the water injected inclinedly downwards out of the water injected from the upper arm 3 to flow into the penetrating hole 166, and shuts off the water injected inclinedly upwards toward the penetrating hole 166 out of the water injected from the lower arm 5 from flowing into the foreign substance intake preventing chamber 230.

For that, the grill cover 250 shown in FIG. 5 may include a rim 252 and a plurality of blind ribs 254 horizontally arranged in an opening formed in the rim 252.

The grill cover 250 may be formed in a horizontally long rectangle shape and the plurality of the blind ribs 254 are horizontally arranged. It is preferred that a vertically arranged reinforcing rib 2 is integrally formed with the middle region of the blind ribs 254.

As shown in FIG. 6, the plurality of the blind ribs 254 may be inclinedly formed in an opposite direction with respect to the bottom 235 of the foreign substance intake preventing chamber 230.

Accordingly, as shown in a solid line arrow of FIG. 7 (*a*), the blind ribs 254 allows only the water injected inclinedly downwards at a preset angle out of the water injected toward the penetrating hole 166 to flowing into the foreign substance intake preventing chamber 230 and prevents the water injected inclinedly upwards from flowing into the foreign substance intake preventing chamber 230.

A bottom 252 of the rim 252 may form the same plane with the bottom 235 of the foreign substance intake preventing chamber 230, so that the water down into the foreign substance intake preventing chamber 230 can flow along the bottom 235 of the foreign substance intake preventing chamber and the bottom of the rim 252 to re-flow into the tub 11.

The water drawn into the foreign substance intake preventing chamber 230 may contain detergent and foreign substances during the washing course. During the reflowing process, the foreign substances may be washed off.

The grill cover 250 shuts off the water injected inclinedly upward from flowing into the foreign substance intake chamber 230, only to prevent the water from flowing toward the air inlet hole 205.

As shown in FIG. 6, it is preferred that the hole cover 210 is rotatably coupled to the top of the air inlet hole 205 and controlled to open and close the air inlet hole 205 by the actuator 220 having a rod (222, see FIG. 7) which is vertically movable.

The actuator 220 having the vertically movable rod 22 may be mounted in the door having a limited thickness only to efficiently utilize the internal space of the door 16, compared with the actuator having a horizontally movable rod. Also, the moving range of the rod 222 may become longer.

The actuator 220 is mounted in a front portion of the inlet duct 200 mounted in the door 16 and an air flow path from the air inlet hole 205 is formed in a rear portion of the inlet duct 200.

The hole cover 210 is not vertically moved by the actuator 220 but rotatably moved to open and close the air inlet hole 205.

The hole cover 210 is rotated by the actuator 220 and it is able to open the air inlet hole 205 more widely than the air inlet hole of the conventional dishwasher.

As shown in FIG. 7, a shaft of the hole cover 210 is rotatably coupled in the inlet duct 200 and an extended portion 212 extended from the shaft in the reverse direction of the hole cover 210 is vertically rotated, only to rotate the hole cover 210.

The hole cover 210 may include a certain region made of a flexible material such as rubber which is in contact with the air inlet hole 205 so as to enhance the airtight sealing. A sealing member 215 formed of a flexible material may be attached to a lower end of the hole cover 210.

A long hole may be formed in the extended portion of the hole cover 210 and the lower end of the rod 222 may pass through the long hole.

The lower end of the rod 222 pass the long hole to horizontally move within the hollow.

The lower end of the rob 222 may push the extended portion downwards or pull it upwards after passing through the long hole.

For that, a support member formed larger than the long hole is coupled to the lower end of the rod 222 having passed through the long hole.

It is preferred that the actuator 220 is a thermal actuator having working fluid expanded when heated to move the rod.

There is a solenoid device as the actuator moving the rod in an axial direction but the solenoid device has the disadvantages of relatively large side and high power consumption.

However, the thermal actuator has the advantages of small size and low power consumption.

As shown in FIGS. 6 and 7, the actuator 220 may be mounted over the air outlet hole 205 of the inlet duct 200 and in an outer portion with respect to the air inlet hole 205. The rod 222 may be projected toward the internal space of the inlet duct 200.

An air plow path for flowing humid air is formed in the inlet duct 200. Only the rod 222 of the actuator 220 rotating the hole cover 210 may be arranged inside the inlet duct 200 and a main body of the actuator may be arranged outside the inlet duct 200. Electric wire has to be connected to the actuator 220 and the humidity permeating into the inlet duct 200 is likely to cause errors in the actuator 220.

As shown in FIG. 4, the inlet duct 200 may further include a blower fan 260 mounted therein to blow the air sucked through the air inlet hole 205 toward the outlet duct 280.

The portion of inlet duct 200 where the blower fan 260 may be mounted is scroll-shaped and the portion connected to the air inlet hole 205 may be connected to a lateral side of the scroll in a streamlined shape.

The outlet duct 280 may be connected to a lower side of the scroll. The air sucked through the air inlet hole 205 flows upwards along the streamlined shape and becomes sucked into to scroll. After that, the air is blown downwards by the blower fan 260 toward the outlet duct 280. The outlet duct 280 is extended to the lower portion of the door 16 and the lower end of the outlet duct 280 is open, so that the internal air of the outlet duct 280 can be exhausted to the lower portion of the door 16.

It is preferred that the blower fan 260 is a centrifugal fan rotary by the motor 270 coupled to the front surface of the inlet duct 200.

The motor 270 is also the electrical components connected to the actuator via wire and coupled to the front outer surface of the inlet duct 200. Only a shaft of the motor is projected into the inlet duct 200 and connected to the blower fan 260 to rotate the blower fan 260.

As shown in FIG. 4, the streamlined portion of the inlet duct 200 is thinner than the scroll portion.

Accordingly, the air drawn into the streamlined portion flows to a backside of the scroll portion and then the air is blown into the outlet duct 280 in a radial direction by the blower fan 260.

When the hole cover 210 rotated by the actuator 220 opens the air inlet hole 205 as shown in FIG. 7 (*b*), the internal air of the tub 11 is sucked into the foreign substance intake preventing chamber 230 and then the inlet duct 200 by the sectional force of the blower fan 260.

According to the present disclosure, the foreign substance intake preventing chamber is provided under the air inlet hole of the inlet duct and allows only the water injected inclinedly downwards out of the water injected toward the inlet hole of the foreign substance intake preventing chamber to flow therein. Accordingly, water is prevented from passing through the air inlet hole and becoming collected in the inlet duct. Also, the foreign substances likely to flow in the foreign substance intake preventing chamber together with the water may be washed off while the water is falling down.

The foregoing embodiments are merely exemplary and are not to be considered as limiting the present disclosure. The present teachings can be readily applied to other types of methods and apparatuses. This description is intended to be illustrative, and not to limit the scope of the claims. Many alternatives, modifications, and variations will be apparent to those skilled in the art. The features, structures, methods, and other characteristics of the exemplary embodiments described herein may be combined in various ways to obtain additional and/or alternative exemplary embodiments. As the present features may be embodied in several forms without departing from the characteristics thereof, it should also be understood that the above-described embodiments are not limited by any of the details of the foregoing description, unless otherwise specified, but rather should be considered broadly within its scope as defined in the appended claims, and therefore all changes and modifications that fall within the metes and bounds of the claims, or equivalents of such metes and bounds, are therefore intended to be embraced by the appended claims.

The invention claimed is:

1. A dishwasher comprising:

a cabinet;

a tub defining a washing space;

a door rotatably coupled to a front portion of the tub;

an outlet duct located in the door and configured to discharge air from the tub to an outside of the dishwasher;

an inlet duct connected to the outlet duct and configured to suction air from the tub and blow suctioned air toward the outlet duct;

a hole cover configured to open and close an air inlet hole that is defined at a bottom surface of the inlet duct;

a foreign substance chamber disposed vertically below the air inlet hole and inclined downwards toward a rear surface of the door, the foreign substance chamber being configured to block entrance of a foreign substance to the air inlet hole;

a penetrating hole defined at the rear surface of the door; and a grill cover that covers the penetrating hole and communicates with the foreign substance chamber, the grill cover being configured to guide water received from an upper portion of the tub to a direction that is inclined downward with respect to the bottom surface of the inlet duct.

2. The dishwasher of claim 1, wherein the foreign substance chamber has a chamber inlet hole oriented in a direction that is inclined downwards with respect to a front of the door.

3. The dishwasher of claim 1, wherein the grill cover comprises:

a plurality of ribs that are inclined with respect to a bottom surface of the foreign substance chamber; and a rim integrally formed with the plurality of the ribs, and wherein the rim includes a surface that is flush with the bottom surface of the foreign substance chamber.

4. The dishwasher of claim 1, wherein the hole cover is configured to:

close the air inlet hole during a washing course; and open the air inlet hole in a standby state or during rinsing and drying courses.

5. The dishwasher of claim 1, further comprising an actuator including a rod that is configured to vertically move to cause rotation of the hole cover to open and close the air inlet hole.

6. The dishwasher of claim 5, wherein the actuator includes a thermal actuator configured to move the rod vertically based on a thermal expansion of fluid in response to heat.

7. The dishwasher of claim 6, wherein the thermal actuator is mounted on an outside of the inlet duct and positioned vertically above the air inlet hole of the inlet duct, and wherein the rod of the actuator is configured to project to an internal space of the inlet duct.

8. The dishwasher of claim 5, wherein the inlet duct further comprises a blower fan configured to blow air suctioned through the air inlet hole toward the outlet duct.

9. The dishwasher of claim 8, wherein the blower fan includes a centrifugal fan configured to be rotated by a motor that is coupled to a front surface of the inlet duct.

10. The dishwasher of claim 9, wherein the outlet duct is connected to a lower end of the inlet duct and configured to discharge air blown by the blower fan to a lower portion of the door.

11. The dishwasher of claim 1, wherein the door includes a door liner that defines an internal space within the door, the internal space being configured to accommodate the inlet duct.

12. The dishwasher of claim 11, wherein a portion of the outlet duct is disposed in the internal space defined within the door, and the outlet duct extends to a lower portion of the door.

13. The dishwasher of claim 3, wherein the plurality of ribs are inclined at a preset angle with respect to the bottom surface of the foreign substance chamber to allow water to flow downwardly into the foreign substance chamber, and to block water from flowing upwards into the foreign substance chamber.

14. The dishwasher of claim 3, wherein the rim includes an upper rim and a lower rim, and the plurality of ribs are located between the upper rim and the lower rim.

15. The dishwasher of claim 14, wherein the lower rim has a surface that is flush with the bottom surface of the foreign substance chamber.

16. The dishwasher of claim 5, wherein the rod of the actuator is configured to project downward to the hole cover in a direction that is offset from a center of the air inlet hole.

17. The dishwasher of claim 16, wherein the hole cover includes:

a first portion configured to cover the air inlet hole based on the hole cover closing the air inlet hole;

a second portion that extends upward from the first portion; and a third portion that extends from the second portion to connect to the rod of the actuator, the third portion being spaced apart from the bottom surface of the inlet duct that defines the air inlet hole.

18. The dishwasher of claim 17, wherein the rod of the actuator is configured to push the third portion of the hole cover downward to open the air inlet hole, and to retract the third portion of the hole cover upward to close the air inlet hole.

* * * * *